United States Patent [19]

Wagner

[11] Patent Number: 4,493,164

[45] Date of Patent: Jan. 15, 1985

[54] METHOD AND APPARATUS FOR DOOR PROTECTION

[76] Inventor: Richard P. Wagner, 825 Casa Loma Dr., Reno, Nev. 89503

[21] Appl. No.: 407,470

[22] Filed: Aug. 12, 1982

Related U.S. Application Data

[63] Continuation of Ser. No. 198,450, Oct. 20, 1980, Pat. No. 4,356,668.

[51] Int. Cl.[3] ..... E06B 65/04

[52] U.S. Cl. ..... 49/65; 49/31

[58] Field of Search ..... 49/63, 65, 67, 56, 61, 49/199, 200, 13, 68, 31, 506, 507, 70; 160/113, 89, 90

[56] References Cited

U.S. PATENT DOCUMENTS

| | | | |
|---|---|---|---|
| 1,749,985 | 3/1930 | Peelle | 49/200 |
| 2,449,326 | 9/1948 | Schaefer | 49/56 |
| 2,458,402 | 1/1949 | Myers | 49/65 X |
| 2,770,455 | 11/1956 | Brister | 49/200 |
| 3,103,967 | 9/1963 | Gaschen | 160/113 |
| 3,616,575 | 11/1971 | Harris | 49/200 |
| 4,356,668 | 11/1982 | Wagner | 49/506 |

*Primary Examiner*—Philip C. Kannan

*Attorney, Agent, or Firm*—Herbert C. Schulze

[57] ABSTRACT

This invention is a method and an apparatus by which a barrier is automatically placed before partially opened doors, which barrier is automatically removed when the door is fully opened and safe for travel. The invention includes means to detect when the door is fully opened and thereupon to activate barrier removal means, together with barrier placement means automatically activated at any time when the door is not fully opened.

2 Claims, 10 Drawing Figures

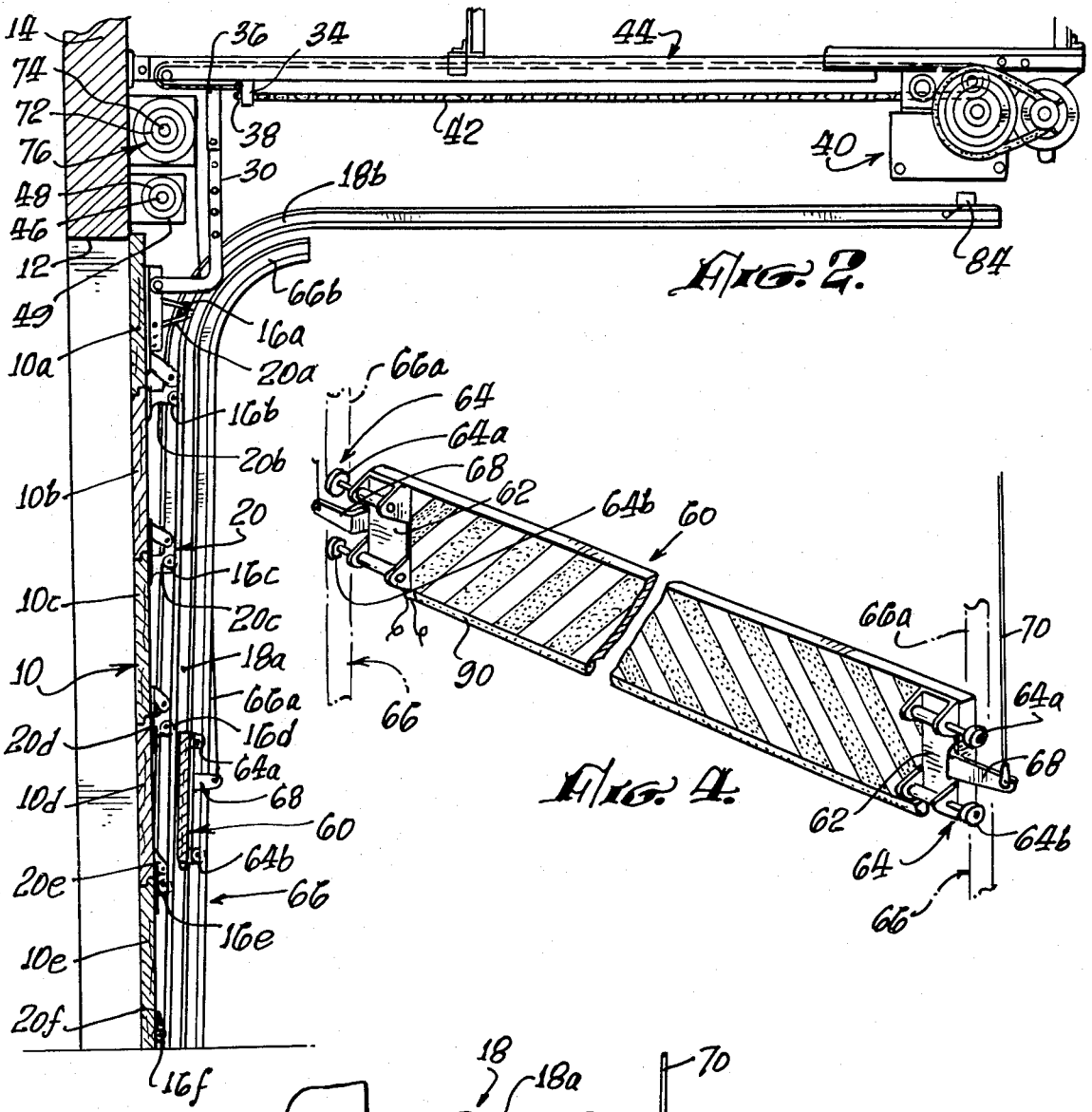
FIG. 2.
FIG. 4.
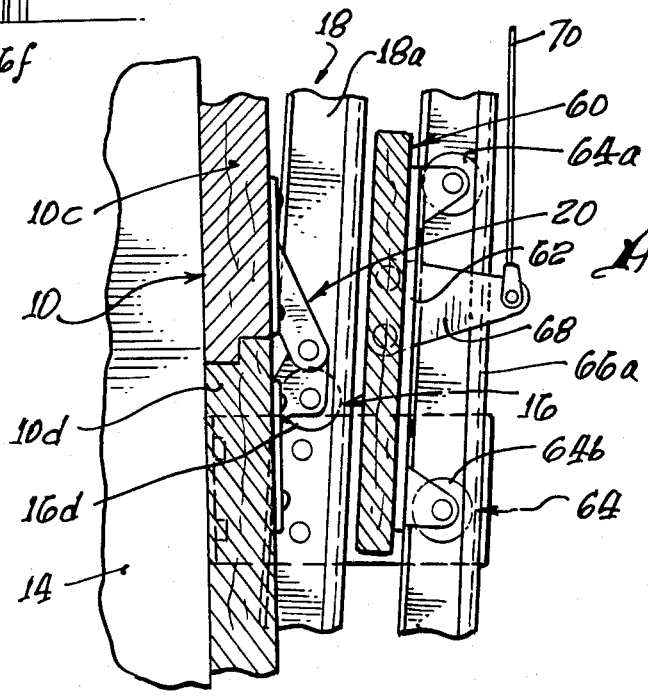
FIG. 5.

FIG. 6.
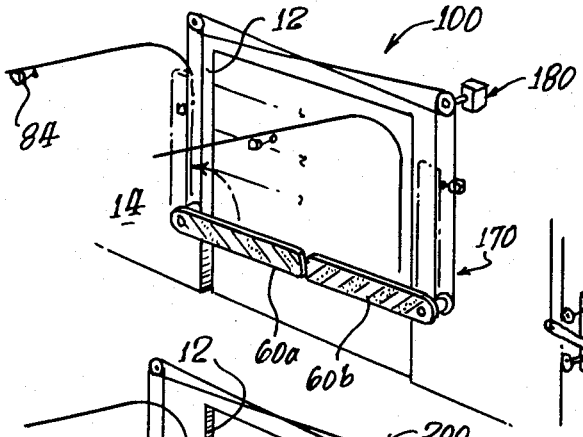
FIG. 9.
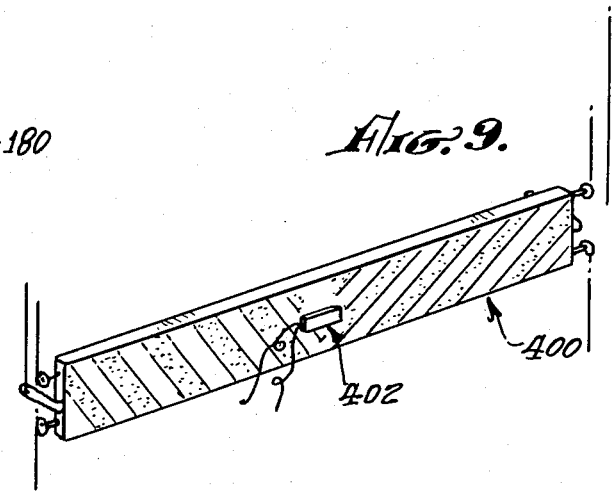
FIG. 7.
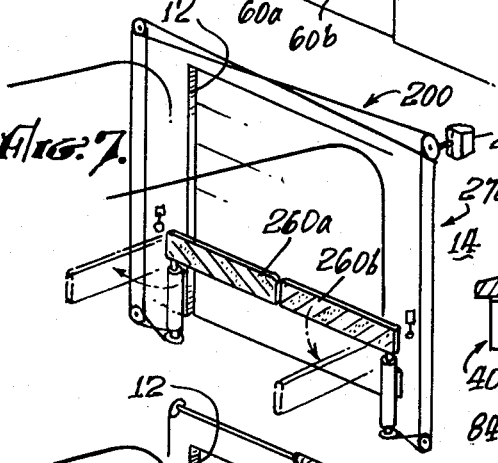
FIG. 8.
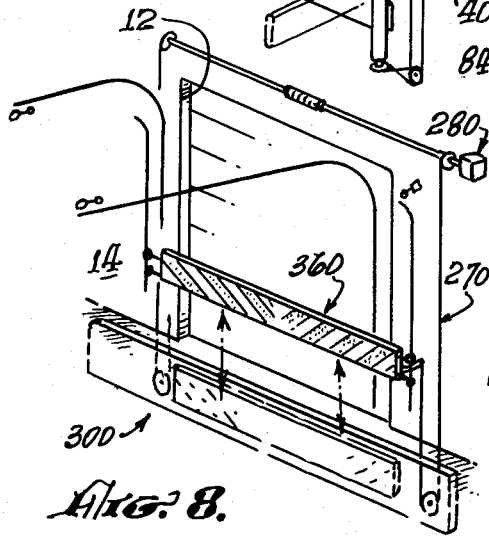
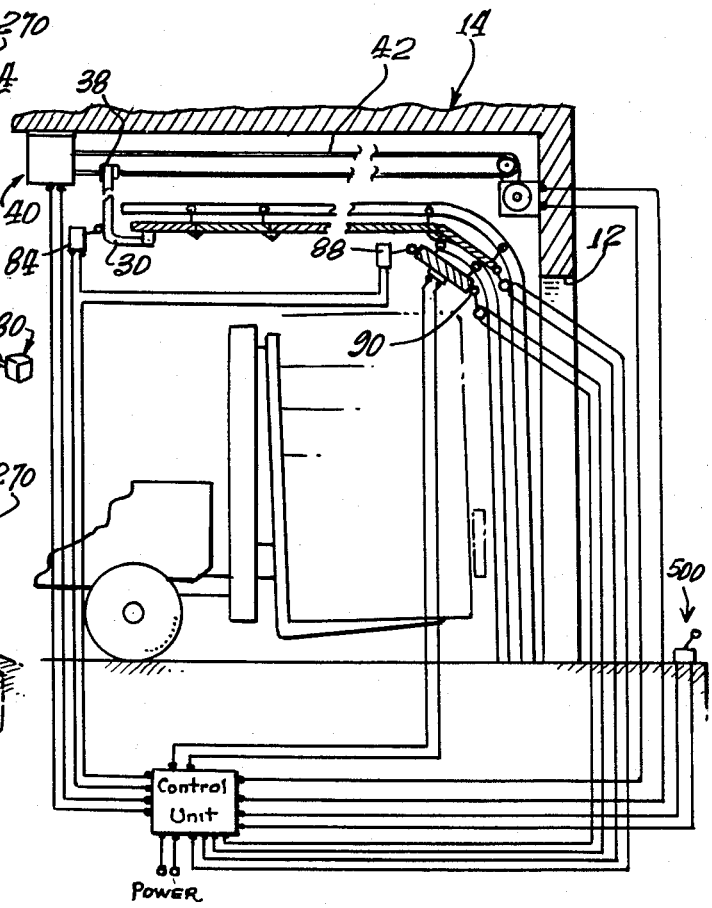
FIG. 10.

METHOD AND APPARATUS FOR DOOR PROTECTION

CROSS-REFERENCE TO RELATED PATENT APPLICATIONS

This is a continuation of copending U.S. patent application Ser. No. 198,450 filed on Oct. 20, 1980 for method and apparatus for door protection, now U.S. Pat. No. 4,356,668.

BACKGROUND OF THE INVENTION

1. Field of the Invention

This invention is in the general field of doors for buildings, and is most particularly directed to doors which open upwardly in warehouses and the like, and even more particularly directed to such doors wherein a barrier is provided to prevent vehicles or persons passing through the door when not fully opened, and is even more particularly directed to such a barrier for a door as described wherein the barrier is automatically removed when the door open condition reaches a predetermined attitude.

2. Description of the Prior Art

I know of no prior art providing for a barrier to prevent passage through a partially opened door, which barrier is automatically removed when the door is fully opened, or when other predetermined conditions with relation to the door are achieved.

THE SUMMARY OF THE INVENTION

I have been engaged in the supply and repair of doors of many types for a long period of time. Particularly, I have been engaged in the supply of doors, such as warehouse doors, and the like, which are stored upward over the door opening and would close by being lowered to the floor.

Many of these doors are utilized in areas where lift trucks and the like are used to carry goods through the doors.

It is common where such doors exist that personnel will partially open the doors for purposes of ventilation, or the like, and frequently under conditions such that it is not desirable to have the door fully opened at all times. Under such circumstances quite frequently lift-truck operators, or the like, will pass through the partially opened door without realizing the height of the lift truck masts of the like, is such as to hit the door. It is a constant problem that such doors are hit by lift trucks, and the like, and cannot then be operated until properly repaired.

Additionally, frequently persons in vehicles will activate a door to open, but because of impatience will advance through the door before it is fully opened, again, frequently resulting in damage to the doors.

I have now devised a movable barrier independently activated, which barrier is activated to an open position only when the door has reached the open position or that other attitude at which it is determined that it is safe to allow passage through the door. I have accomplished this in several alternate embodiments including an embodiment which rises overhead, an embodiment which swings to the side, and a few other embodiments which are described in more detail. In each case, each of the embodiments is incapable of removal until the door reaches the particular attitude desired.

In another alternate embodiment, I have provided a cooperating and secondary arrangement which does not allow removal of the barrier until some other condition, in addition to the door attitude condition, has been met. For example, frequently at loading docks and during hours of poor light, a lift truck may run off the dock thinking it is running onto a parked truck By an addition of an auxiliary activation means, the barrier cannot move unless there is a truck or the like, at the loading dock and the door has also reached the appropriate attitude.

It is an object of this invention to provide a barrier to block passage through a doorway until the door reaches a desired attitude.

Another object of this invention is to provide such a barrier as has been described wherein the barrier automatically removes itself when the appropriate precondition of the door has been met.

Another object of this invention is to provide such a barrier as described wherein there will be a secondary condition which must be met in addition to the condition of the door.

The foregoing and other objects and advantages will become apparent to those skilled in the art upon reading the description of a preferred embodiment which follows, in conjunction with a review of the appended drawings.

BRIEF DESCRIPTION OF THE DRAWINGS

FIG. 2 is a side elevation of the device of FIG. 1;

FIG. 4 is a perspective view of the barrier used in my invention;

FIG. 5 is an enlarged fragmentary section taken on line 5—5 of FIG. 1;

FIGS. 6, 7 and 8 are schematic perspective views showing alternate embodiments of barriers;

FIG. 9 is a fragmentary perspective view indicating another method of detecting contact with the barrier; and FIG. 10 is a typical schematic view showing the placement of switches to control some aspects of my invention.

DESCRIPTION OF A PREFERRED EMBODIMENT

Figure 1:
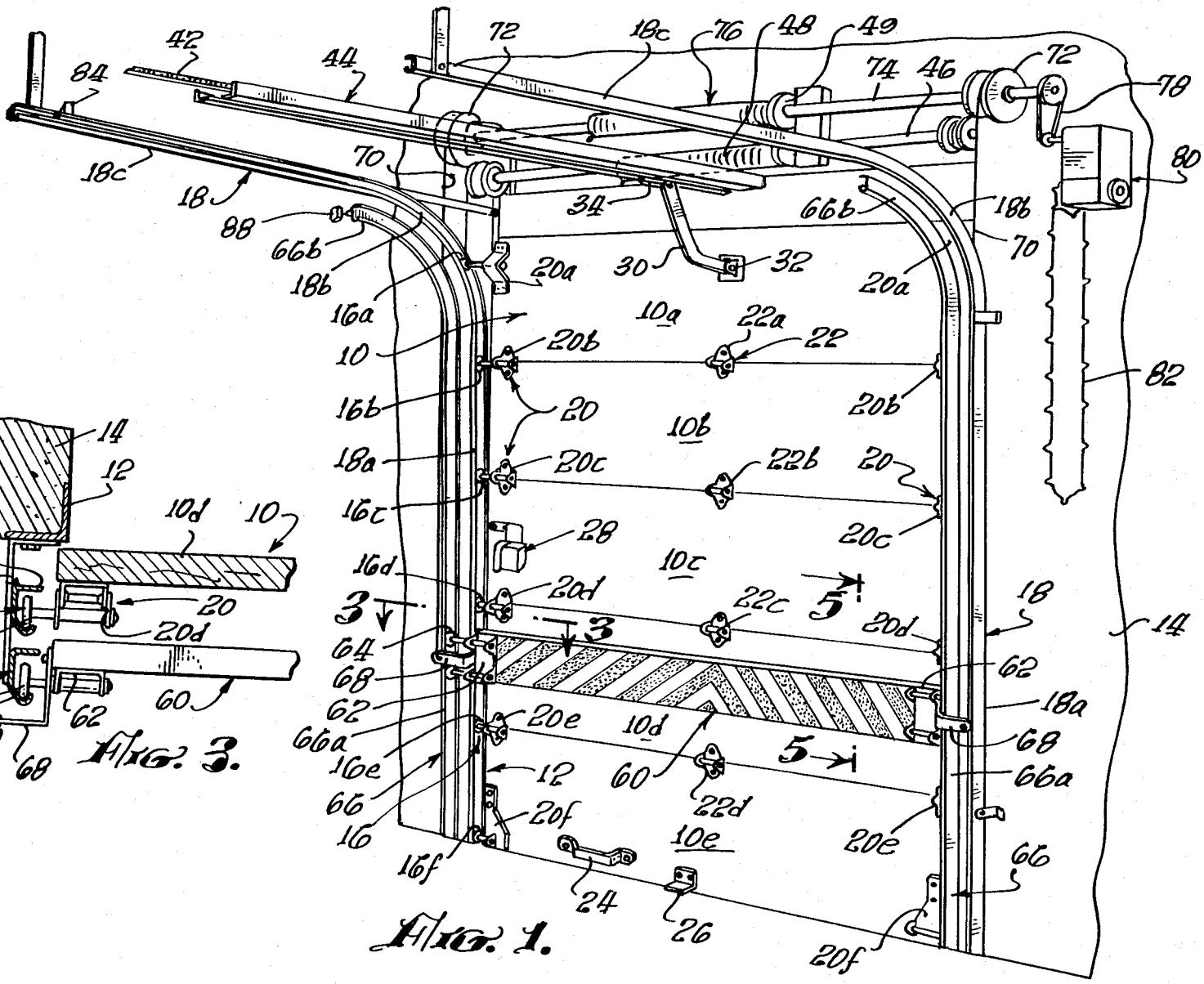
FIG. 1 is a perspective view of the invention as it is mounted onto an overhead door assembly.
Figure 3:
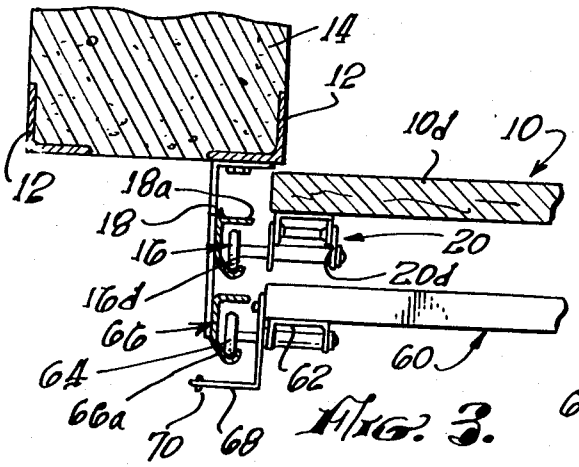
FIG. 3 is an enlarged fragmentary section taken on line 3—3 of FIG. 1.

The perspective view of FIG. 1 shows an upwardly opening door assembly 10 comprised of hinged segments 10*a* through 10*e* To those familiar in the art, the door assembly fits over an opening 12 in a building structure 14. The door assembly has a plurality of rotatably mounted roller assemblies 16 attached thereto. These rollers, as indicated by the reference numeral 16*a* through 16*f* ride in a rail assembly 18. The rail assembly comprises vertical sections 18*a* blending into curved sections 18*b* and terminating in horizontal sections 18*c*.

Combination bracket and hinge assemblies 20, as indicated by the reference numerals 20*a* through 20*f* are provided to rotatably support the roller assembly 16.

Each of the segments 10*a* through 10*e* are connected between their edges by means of center hinges 22. 22*a* connects segments 10*a* and 10*b;* hinge 22*b* connects segments 10*b* and 10*c;* hinge 22*c* connects sections 10*c* and 10*d;* and hinge 22*d* connects segments 10*d* and 10*e*.

A handle 24 is placed onto the door in order to manually lift or lower the door. An angular foot pressing member 26 can be attached to the lower door segment 10*e* in order to fully bring the door down to the floor level of the building. A conventional slide bolt or hasp-type of door locking means 28 is provided.

A connecting arm 30 which is pivotally secured at 32 to the topmost door segment 10*a* is also pivotally mounted to a connecting block member 34. This connecting block member has connection points 36 and 38 for a chain 42 actuated by drive means 40. The member 30 slides within a slotted track member 44 and lifts and lowers the door assembly upon actuation of the drive means 40.

A counter balance jack shaft 46 which is connected to counter balance spring member 48 is rotatably mounted on blocks 49 which in turn are affixed to the building structure 14. When the door is lowered to floor level, the spring 48 is wound about the jack shaft 46 and counter balances the load of the door so that it can be more easily lifted when it is moved upwardly to an open condition. This type of door operating method is familiar to anyone working in the business of installing or manufacturing such doors and there is no need to elaborate the operation of such devices in any more detail than has been presented.

A barricade 60, which is the subject of my invention, is located at a point at approximatly the level which a lift truck or a lift truck load would contact it when it is in its blocking position. The barricade can be constructed of a material such as wood or metal and can be reinforced to withstand the pressure of a moving vehicle such as a fork lift. Roller assemblies 64 which are rotatably mounted on bracket 62 are affixed to barricade 60, ride in tracks 66. Upper and lower roller assemblies 64*a* and 64*b* ride in left and right track assemblies 66 along a vertical section 66*a* of these tracks until the barricade has been lifted and slightly turned in the bowed sections 66*b* of the track 66. The lifting and lowering of this barricade assembly is accomplished by a cable 70 affixed to a bracket 68 on the barricade and wound about a cable reel 72 on a second jack shaft 74. The jack shaft is rotatably powered by a drive unit 80 through its pulleyed belt 78. A counter balance spring assembly 76 is wound about this shaft in a fashion similar to that described in the counter shaft of the door lifting mechanism.

A hand operated chain 82 can be attached to the power unit 80 in order to manually accompish the lifting of the barricade by hand should anything go wrong with the operating mechanism.

A limit switch 84 located at a point along the track assembly for the door 10 is located at such a point so as to become operative when the door is in its uppermost and clear position. Then, and only then, can the barrier be removed. When the barrier has been moved into a condition where it also can clear the load or lift truck then it actuates a switch 88 to stop its upward movement by the power unit 80.

The bottom of the barricade 60 can be provided with a sensing mechanism 90 such as a pneumatic or hydraulic sensing member 90. Any pressure on this member can stop all of the door and barricade operation until the obstruction has been taken away from the barricade. This arrangement would eliminate any damage to a vehicle or load which has been trapped beneath the door or barrier should the door or barrier be prematurely activated.

As shown in FIG. 9 a strain gauge 402 can be attached to the barricade 400 and any pressure against the barricade which would distort it would activate a warning signal Such strain gauges are readily available on the market as known to those familiar in the art.

A first alternate embodiment 100 as shown in FIG. 6 utilizes a barrier made of two segments 60*a* and 60*b*. This barrier assembly is actuated by cable assembly 170, in a simple manner as illustrated. The drive unit 180 would function when a door assembly has cleared its safety condition and through the cable assembly 170 would move the barrier segments 60*a* and 60*b* upwardly and out of the way of the operating vehicle or load. This is similar to the action of a railroad crossing barricade. The same limit switches would pertain to this embodiment as described earlier in this application.

A second alternate embodiment 200 as illustrated in the perspective of FIG. 7 shows the barrier members 260*a* and 260*b* swinging about a vertical axis in order to clear the doorway after the door assembly is in a safe condition. The cable actuating means 270 operated by the drive unit 280 would cause this actuation. Limit switches would also be located in this case at a point to allow actuation after the door assembly had been cleared.

A third alternate embodiment 300 as illustrated in the perspective of FIG. 8 can be actuated to clear the passageway by moving downwardly into a recess in the floor. The barrier 360 in this case is actuated by cable assembly 370 and operating unit 380.

It is to be understood that the barriers or barricades in the heretofore described preferred and alternate embodiments can be placed on either side of the door opening. It is also a simple matter to provide such a barricade assembly both on the inside and outside of the door opening. A sensing device 500 can be placed elsewhere to the door opening in order to insure that warning is given to an operator of a fork lift whose visibility is obstructed by a load, that the receiving truck or trailer has not been placed into position at the loading dock. This alternate warning device can work in conjunction with the safety means described letting the fork lift operator to know that the door has cleared its safety position.

The simplified circuit diagram of FIG. 10 illustrates all of the components described earlier in this application but showing the door and barricade in the raised or cleared position. Audible and visual warning systems can be inserted into the whole system to tell the operator when the barricade has been contacted by the fork lift or load.

It is to be understood that the door can be composed of a shutter construction, a rolling grille construction, or an accordion grille type. Conventional automobile garage doors can be adapted to the use of the invention in order to keep the vehicle operator from backing out of a garage door prior to its being raised into a safe condition. The doors can also be constructed of insulative material.

While the embodiments of this invention shown and described are fully capable of achieving the objects and advantages desired, it is to be understood that such embodiments are for the sole purpose of illustration and not for the purposes of limitation.

I claim:

1. Apparatus for preventing passage through a door opening comprising in combination: a structure containing a door opening; a door movable with relation to such door opening so that the entire door opening or any portion thereof may be closed depending upon the position of the movable door; door position detection means operable by means cooperable with said door so as to detect a predetermined position of closure of the door opening; barrier means independent of said door to prevent access through the door opening; and means activated by the said detection means to remove said barrier means from its position with relation to said door opening.

2. An apparatus as set forth in claim 1 wherein said barrier means includes: a track means near said door opening; a roller means attached to said barrier means which rides in said track means; and said roller means movable in said track means to move said barrier means away from said door opening.

* * * * *